US008464537B2

(12) United States Patent
Khan et al.

(10) Patent No.: US 8,464,537 B2
(45) Date of Patent: Jun. 18, 2013

(54) FUEL NOZZLE FOR COMBUSTOR

(75) Inventors: Abdul Rafey Khan, Greenville, SC (US); Willy Steve Ziminsky, Simpsonville, SC (US); Christian Xavier Stevenson, Inman, SC (US)

(73) Assignee: General Electric Company, Schenectady, NY (US)

( * ) Notice: Subject to any disclaimer, the term of this patent is extended or adjusted under 35 U.S.C. 154(b) by 80 days.

(21) Appl. No.: 12/909,092

(22) Filed: Oct. 21, 2010

(65) Prior Publication Data

US 2012/0096866 A1 Apr. 26, 2012

(51) Int. Cl.
*F02C 1/00* (2006.01)

(52) U.S. Cl.
USPC ..... 60/737; 60/742; 60/748

(58) Field of Classification Search
USPC ..... 60/733, 737, 738, 740, 742, 746, 60/748
See application file for complete search history.

(56) References Cited

U.S. PATENT DOCUMENTS

| | | | | |
|---|---|---|---|---|
| 5,669,218 | A | 9/1997 | Greninger | |
| 5,816,041 | A | 10/1998 | Greninger | |
| 5,826,423 | A * | 10/1998 | Lockyer et al. | 60/39.463 |
| 5,899,074 | A | 5/1999 | Komatsu et al. | |
| 6,047,550 | A | 4/2000 | Beebe | |
| 6,070,411 | A * | 6/2000 | Iwai et al. | 60/737 |
| 6,192,688 | B1 | 2/2001 | Beebe | |
| 6,223,537 | B1 | 5/2001 | Lipinski et al. | |
| 6,429,020 | B1 | 8/2002 | Thornton et al. | |
| 6,675,581 | B1 | 1/2004 | Stuttaford et al. | |
| 6,691,516 | B2 | 2/2004 | Stuttaford et al. | |
| 6,722,132 | B2 | 4/2004 | Stuttaford et al. | |
| 6,857,271 | B2 | 2/2005 | Kraft et al. | |
| 6,887,069 | B1 | 5/2005 | Thornton et al. | |
| 6,898,937 | B2 | 5/2005 | Stuttaford et al. | |
| 6,915,636 | B2 | 7/2005 | Stuttaford et al. | |
| 7,165,405 | B2 | 1/2007 | Stuttaford et al. | |
| 7,707,833 | B1 * | 5/2010 | Bland et al. | 60/737 |

OTHER PUBLICATIONS

U.S. Appl. No. 12/835,227, filed Jul. 13, 2010.
U.S. Appl. No. 12/652,858, filed Jan. 6, 2010.

* cited by examiner

*Primary Examiner* — Ehud Gartenberg
*Assistant Examiner* — Arun Goyal
(74) *Attorney, Agent, or Firm* — Dority & Manning, PA

(57) ABSTRACT

A nozzle for a combustor is disclosed. The nozzle includes a center body, a burner tube provided around the center body and defining a fuel-air mixing passage therebetween, and an outer peripheral wall provided around the burner tube and defining an air flow passage therebetween. The nozzle further includes a nozzle tip connected to the center body. The nozzle tip includes a pilot fuel passage configured to deliver a flow of pilot fuel to a combustion zone, and a plurality of transfer passages. The plurality of transfer passages are configured to deliver a flow of air for combustion with the flow of pilot fuel in the combustion zone and further configured to deliver a flow of transfer fuel to the combustion zone.

15 Claims, 8 Drawing Sheets

FUEL NOZZLE FOR COMBUSTOR

FIELD OF THE INVENTION

The present disclosure relates in general to combustors, and more particularly to fuel nozzles in combustors.

BACKGROUND OF THE INVENTION

Gas turbine systems are widely utilized in fields such as power generation. A conventional gas turbine system includes a compressor, a combustor, and a turbine. In a conventional gas turbine system, compressed air is provided from the compressor to the combustor. The air entering the combustor is mixed with fuel and combusted. Hot gases of combustion flow from the combustor to the turbine to drive the gas turbine system and generate power.

As requirements for gas turbine system emissions have become more stringent, one approach to meeting such requirements is to utilizing lean fuel and air mixtures in a fully premixed operations mode in the combustor to reduce emissions of, for example, NOx and CO. These combustors are known in the art as Dry Low NOx (DLN), Dry Low Emissions (DLE) or Lean Pre Mixed (LPM) combustion systems. These combustors typically include a plurality of primary nozzles which are ignited for low load and mid load operations of the combustor. During fully premixed operations, the primary nozzles supply fuel to feed a secondary flame. The primary nozzles typically surround a secondary nozzle that is utilized for mid load up to fully premixed mode operations of the combustor.

Secondary nozzles serve several functions in the combustor, including supplying fuel for the fully premixed mode, supplying fuel and air for a pilot flame supporting primary nozzle operation, and providing transfer fuel for utilization during changes between operation modes. In pilot mode, fuel for the operation of the pilot is directed through a pilot fuel passage typically located in the center of the fuel nozzle and air to mix with the pilot fuel is provided via a plurality of pilot air passages surrounding the pilot fuel passage. During transfer operation of the fuel nozzle, additional fuel is urged through the nozzle and into the combustion zone through a group of transfer passages located in the nozzle separate from the pilot fuel passage as a distinct flow of fuel. When the nozzle is not in transfer mode, the current practice is to purge the transfer passages of fuel by flowing transfer air through the transfer passages. In this operation the pilot is surrounded by this flow of lower temperature purge air. Separate passages in the secondary nozzle for pilot fuel, transfer fuel and air, and pilot air result in a complex nozzle assembly. Additionally, the pilot of the typical nozzle is fuel limited due to the configuration of the pilot fuel and air passages, so that high reactivity fuels cannot be utilized in the pilot.

Further, typical prior art secondary nozzles risk permanent damage due to flame-holding, when a flame is held in or adjacent to the nozzle. Because high reactivity fuels increase the risk of flame holding, the use of high reactivity fuels is thus further limited.

Thus, an improved secondary nozzle for a gas turbine system would be desired in the art. For example, a secondary nozzle that has a simple configuration and can perform several functions would be advantageous. Further, a secondary nozzle that resists permanent damage due to flame-holding would be advantageous.

BRIEF DESCRIPTION OF THE INVENTION

Aspects and advantages of the invention will be set forth in part in the following description, or may be obvious from the description, or may be learned through practice of the invention.

In one embodiment, a nozzle for a combustor in a gas turbine system is disclosed. The nozzle includes a center body, a burner tube provided around the center body and defining a fuel-air mixing passage therebetween, and an outer peripheral wall provided around the burner tube and defining an air flow passage therebetween. The nozzle further includes a nozzle tip connected to the center body. The nozzle tip includes a pilot fuel passage configured to deliver a flow of pilot fuel to a combustion zone, and a plurality of transfer passages. The plurality of transfer passages are configured to deliver a flow of air for combustion with the flow of pilot fuel in the combustion zone and further configured to deliver a flow of transfer fuel to the combustion zone.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
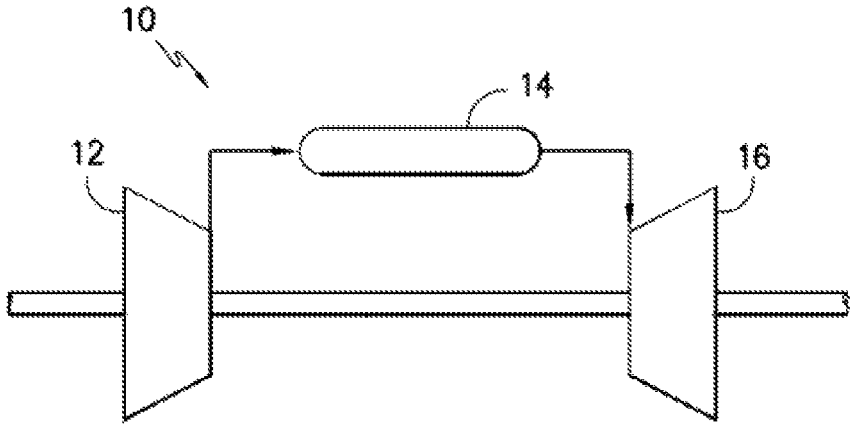
FIG. 1 is a schematic view of one embodiment of a gas turbine system according to the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring to FIG. 1, a schematic view of a gas turbine system 10 is illustrated. The system 10 comprises a compressor section 12 for pressurizing a gas, such as air, flowing into the system 10. It should be understood that while the gas may be referred to herein as air, the gas may be any gas suitable for use in a gas turbine system 10. Pressurized air discharged from the compressor section 12 flows into a combustor section 14, which is generally characterized by a plurality of combustors disposed in an annular array about an axis of the system 10. The air entering the combustor section 14 is mixed with fuel and combusted. Hot gases of combustion flow from the combustor section 14 to a turbine section 16 to drive the system 10 and generate power.

Figure 2:
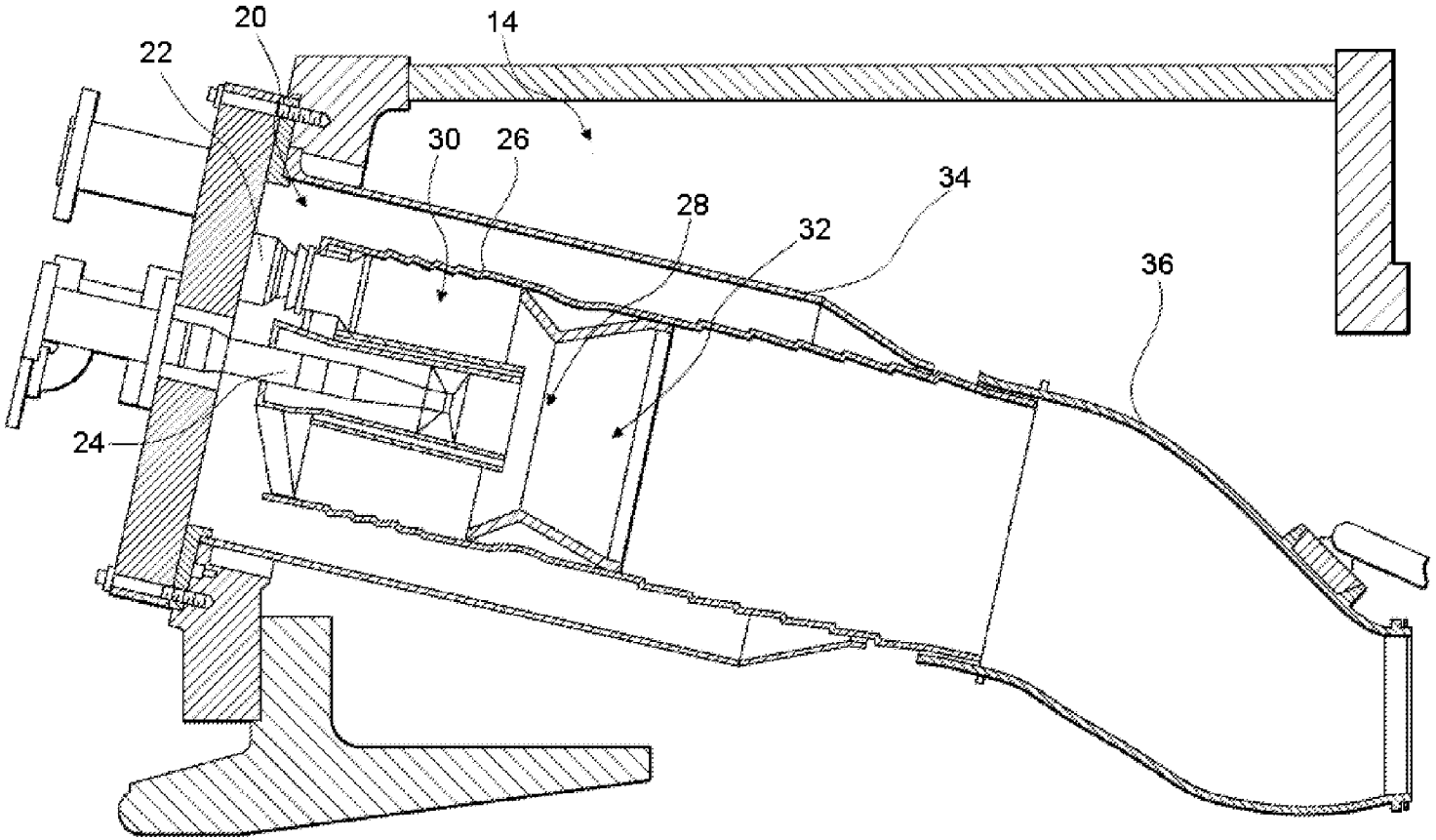
FIG. 2 is a cross-sectional view of one embodiment of a combustor according to the present disclosure.

Referring to FIG. 2, the combustor 14 according to one embodiment includes a combustor head end 20 having an array of primary nozzles 22, only one of which is shown in FIG. 2, and a secondary nozzle 24. A combustion chamber liner 26 comprises a venturi 28 provided between a primary combustion chamber 30 and a secondary combustion chamber 32. The combustion chamber liner 26 is provided in a combustor flow sleeve 34. A transition duct 36 is connected to the combustion chamber liner 26 to direct the combustion gases to the turbine.

Figure 3:
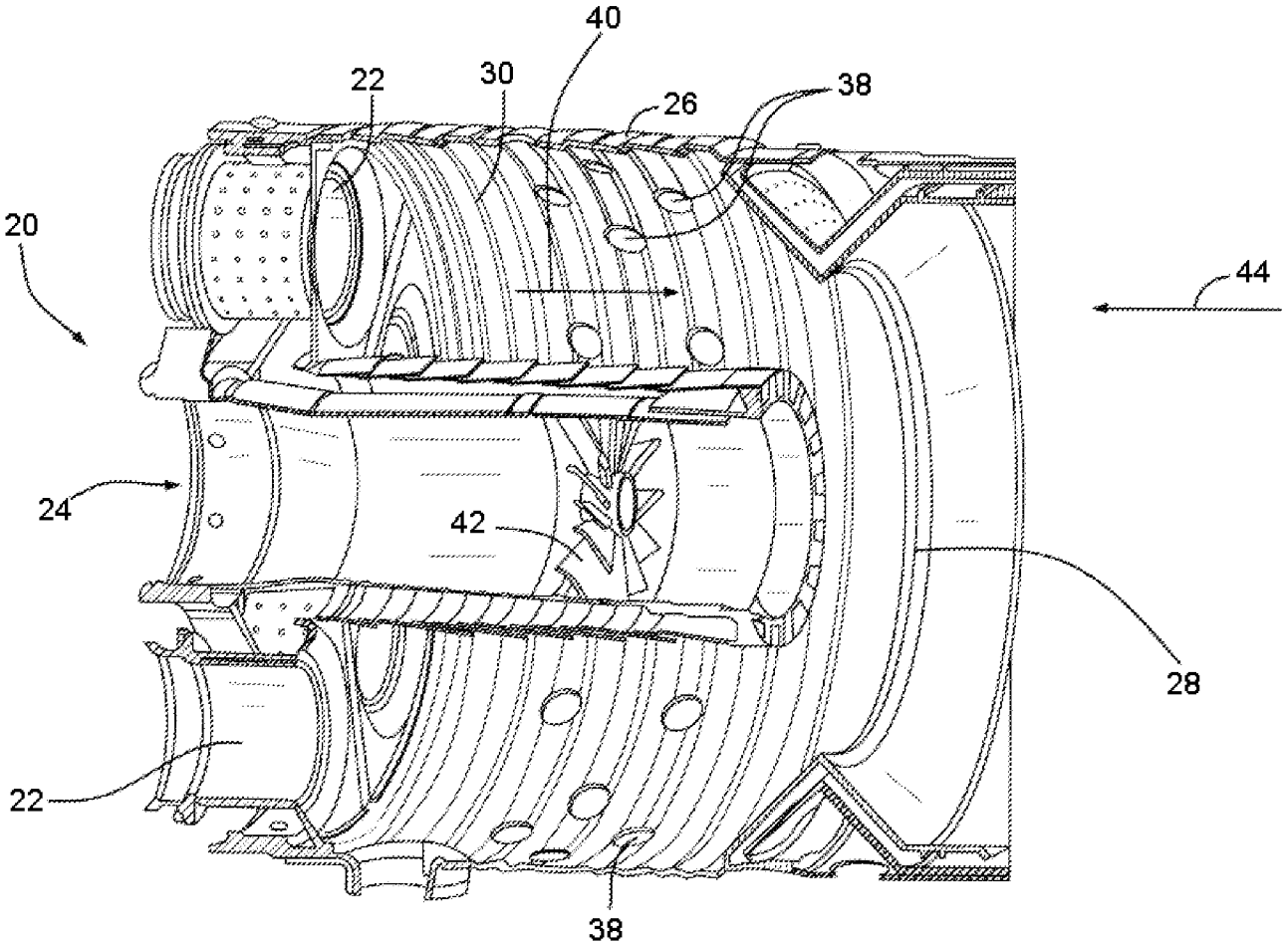
FIG. 3 is a perspective view of one embodiment of a combustor head end according to the present disclosure.

Referring to FIG. 3, the combustor head end 20 comprises the array of primary nozzles 22 and the secondary nozzle 24. As shown in FIG. 3, the primary nozzles 22 are provided in a circular array around the secondary nozzle 24. It should be appreciated, however, that other arrays of the primary nozzles 22 may be provided.

The combustion chamber liner 26 comprises a plurality of combustion chamber liner holes 38 through which compressed air flows to form an air flow 40 for the primary combustion chamber 30. It should also be appreciated that compressed air flows on the outside of the combustion chamber liner 26 to provide a cooling effect to the primary combustion chamber 30.

The secondary nozzle 24 comprises a plurality of swirl vanes 42 that are configured to pre-mix fuel and air as will be described in more detail below. The secondary nozzle 24 extends into the primary combustion chamber 30. The secondary nozzle 24 may extend only into the primary combustion chamber 30, and not extend into the venturi 28 or into the secondary combustion chamber 32, or the secondary nozzle 24 may extend into the venturi 28 and, optionally, past the venturi 28 into the secondary combustion chamber 32.

As discussed below, reference numeral 44 refers to a flame speed if flashback occurs during combustion.

Figure 4:
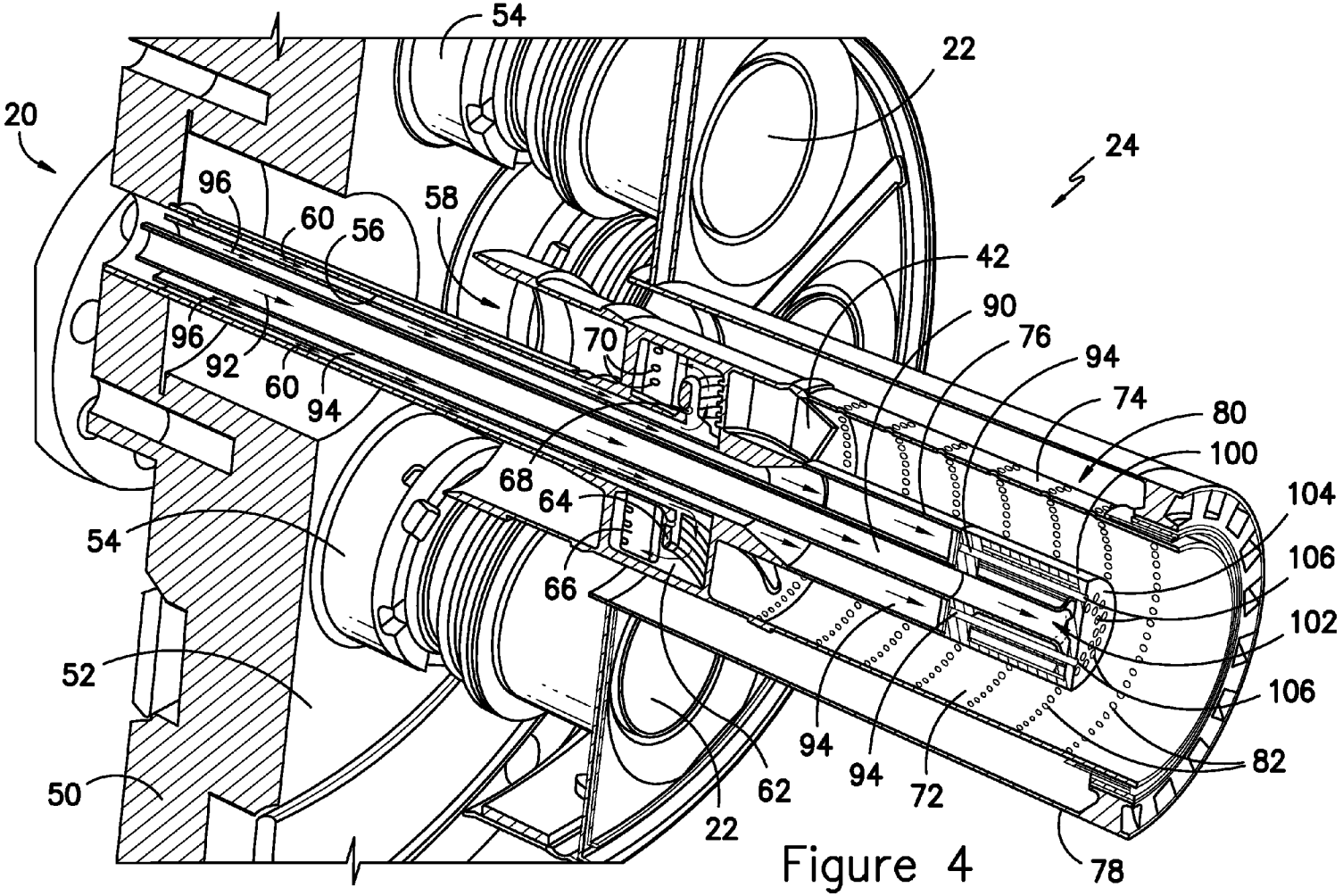
FIG. 4 is a perspective view of one embodiment of a combustor head end including a secondary fuel nozzle according to the present disclosure.

Referring to FIG. 4, the combustor head end 20 comprises an end cover 50 having an end cover surface 52 to which the primary nozzles 22 are connected by sealing joints 54. The secondary nozzle 24 comprises a premix fuel passage 56 that is supported by the end cover 50. The secondary nozzle 24 further comprises an air flow inlet 58 for the introduction of air into the secondary nozzle 24.

Figure 11:
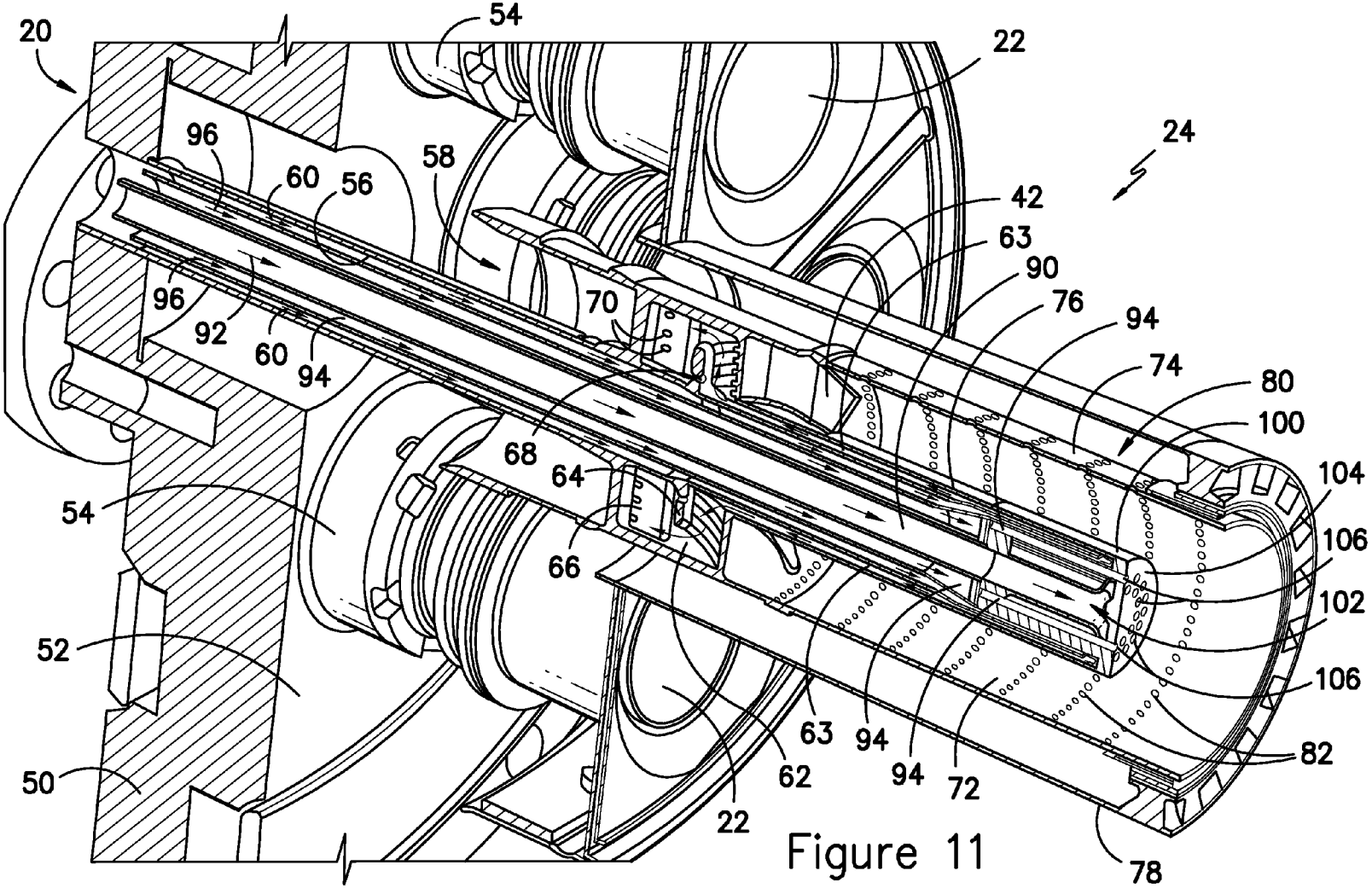
FIG. 11 is a perspective view of another embodiment of a combustor head end including a secondary fuel nozzle according to the present disclosure.

As shown, fuel 60 may flow downstream through premix fuel passage 56. As used herein, the term downstream refers to a direction of flow of the combustion gases through the combustor toward the turbine and the term upstream may represent a direction away from or opposite to the direction of flow of the combustion gases through the combustor. The fuel 60 may then be exhausted into a fuel-air mixing passage, as discussed below. For example, in some embodiments as shown in FIG. 4, the fuel 60 may flow from the premix fuel passage 56 into a cooling chamber 62 defined in each swirl vane 42. In other embodiments as shown in FIG. 11, the fuel 60 may flow through the premix fuel passage 56 past the swirl vanes 42. The fuel 60 may then flow from the premix fuel passage 56 into a reverse flow passage 63. The fuel 60 may flow upstream through the reverse flow passage 63 and into the cooling chamber 62 defined in each swirl vane 42. In these embodiments, the premix fuel passage 56 and the reverse flow passage 63 extend through at least a portion of the nozzle center body, discussed below, and, optionally as shown in FIG. 11, the nozzle tip, discussed below. The reverse flow of fuel 60 through the reverse flow passage 63 may cool the peripheral surfaces of the nozzle center body and, optionally, the nozzle tip.

The fuel 60 may then flow around a divider 64 into an outlet chamber 66 defined in each swirl vane 42. The divider 64 may, for example, be a piece of metal that restricts the direction of flow of the fuel into the outlet chamber 66, thus causing the fuel to internally cool all surfaces of the vanes 42. The cooling chamber 62 and the outlet chamber 66 may be described as a non-linear coolant flow passage, e.g., a zigzag coolant flow passage, a U-shaped coolant flow passage, a serpentine coolant flow passage, or a winding coolant flow passage. A portion of the fuel 60 may also flow directly from the cooling chamber 62 to the outlet chamber 66 through a by-pass hole 68 formed in the divider 64.

The by-pass hole 68 may allow, for example, approximately 1-50%, 5-40%, or 10-20%, of the total fuel 60 flowing from the cooling chamber 62 into the outlet chamber 66 to flow directly between the chambers 62, 66. Utilization of the by-pass hole 68 may allow for adjustments to any fuel system pressure drops that may occur, adjustments for conductive heat transfer coefficients, or adjustments to fuel distribution to fuel injection ports 70. The by-pass hole 68 may improve the distribution of fuel into and through the fuel injection ports 70 to provide more uniform distribution. The by-pass hole 68 may also reduce the pressure drop from the cooling chamber 62 to the outlet chamber 66, thereby helping to force the fuel 60 through the fuel injection ports 70. Additionally, the use of the by-pass hole 68 may allow for tailored flow through the fuel injection ports 70 to change the amount of swirl that the fuel flow contains prior to injection into a fuel-air mixing passage 72 via the injection ports 70.

The fuel 60 may be ejected from the outlet chamber 66 through the fuel injection ports 70 formed in the swirl vanes 42. The fuel 60 is injected from the fuel injection ports 70 into the fuel-air mixing passage 72 for mixing with the air flow from the air flow inlet 58 of the secondary nozzle 24. The swirl vanes 42 swirl the air flow from the air flow inlet 58 to improve the fuel-air mixing in the passage 72.

Referring still to FIG. 4, the secondary nozzle 24 includes a burner tube 74 that surrounds a nozzle center body 76. The nozzle center body 76 is downstream of the swirl vanes 42. Further, the nozzle center body 76 may be downstream of the premix fuel passage 56, or the premix fuel passage 56 may extend through at least a portion of the nozzle center body 76. The fuel-air mixing passage 72 is provided between the nozzle center body 76 and the burner tube 74. An outer peripheral wall 78 is provided around the burner tube 74 and defines a passage 80 for air flow. The burner tube 74 includes a plurality of rows of air cooling holes 82 to provide for cooling by allowing the air flow through passage 80 to form a film on the burner tube 74, protecting it from hot combustion gases. The holes 82 may be angled in the range of 0° to 45° degree with reference to a downstream wall surface. The hole size, the number of holes in a circular row, and/or the distance between the hole rows may be arranged to achieve the desired wall temperature during flame holding events.

During secondary, or full premixed, operation of the combustor 14, fuel is supplied via premix fuel passage 56, discussed above, to the cooling chamber 62. Further, as shown, the secondary fuel nozzle 24 includes a plurality of fuel passages extending through the premix fuel passage 56 that are utilized at different times depending on the operation mode of the combustor 14. For example, a pilot fuel passage 90 or passages 90 may be defined in the secondary nozzle 24, such as in the center of the secondary nozzle 24. The pilot fuel passage 90 supplies fuel 92 for, for example, pilot operation of the secondary nozzle 24. The pilot fuel 92 may be, for example, a high reactivity fuel. A plurality of transfer passages 94 are also defined in the secondary nozzle 24. The transfer passages 94 may, for example, extend substantially axially within the secondary nozzle 24, and may be located radially outboard of the pilot fuel passage 90. The plurality of transfer passages 94 supply transfer fuel 96 for use during transitions between modes.

Figure 5:
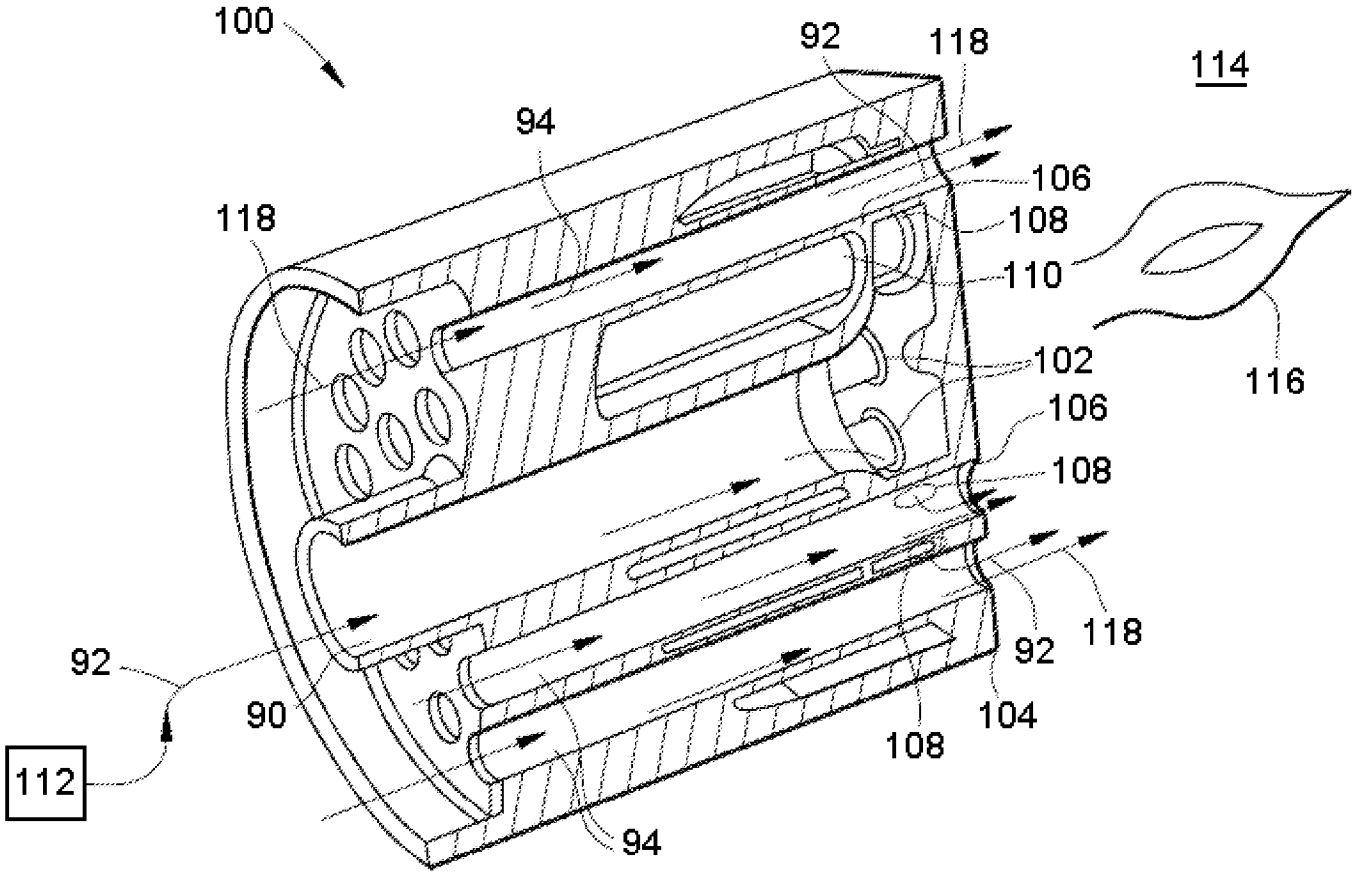
FIG. 5 is a cross-sectional view of one embodiment of a tip of a secondary fuel nozzle according to the present disclosure.
Figure 6:
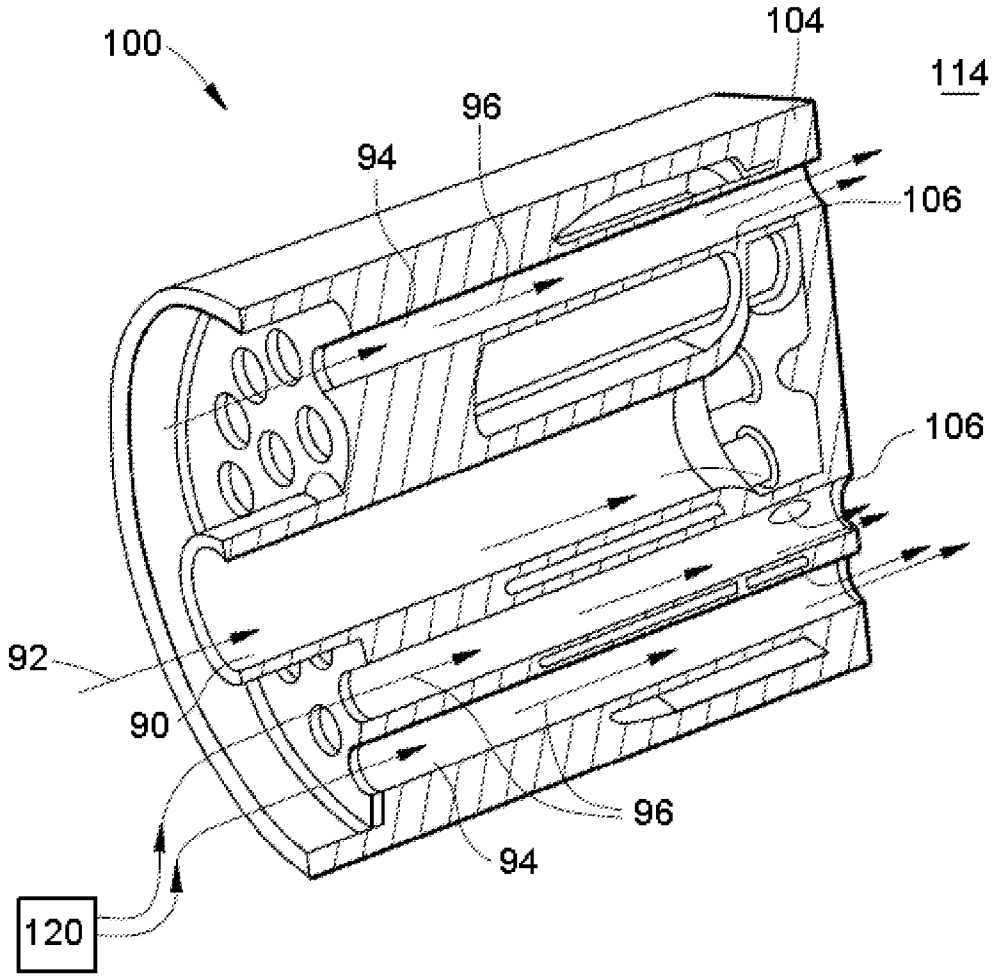
FIG. 6 is a cross-sectional view of another embodiment of a tip of a secondary fuel nozzle according to the present disclosure.

The pilot fuel passage 90 and various of the transfer passages 94 extend into and through a nozzle tip 100 connected to the nozzle center body 76 and disposed on the downstream end of the secondary nozzle 24. As shown in FIGS. 4 through 6, the pilot fuel passage 90 may extend through the nozzle tip 100 to a diffuser 102 located at a tip end 104. The plurality of transfer passages 94 may extend through the nozzle tip 100, exiting the secondary nozzle 24 at a plurality of tip holes 106. The pilot fuel passage 90 may be connected to the plurality of transfer passages 94 via a plurality of pilot holes 108 defined in sidewalls 110 of the plurality of transfer passages 94. The pilot fuel passage 90 is connected to a pilot fuel source 112.

When the secondary nozzle 24 is operating as a pilot, for example, in pilot mode, as shown in FIG. 5, a flow of pilot fuel 92 is urged through the pilot fuel passage 90, and may proceed through the diffuser 102. The flow of pilot fuel 92 may further proceed through the plurality of pilot holes 108, through the plurality of transfer passages 94. The pilot fuel 92 in the diffuser 102 and the passages 90, 94 may cool the tip 100. The pilot fuel 92 may then exit the transfer passages 94 into a combustion zone 114 to fuel a pilot flame 116.

Further, during pilot mode operation of the secondary nozzle 24, a flow of pilot air 118 is urged through the plurality of transfer passages 94. The flow of pilot air 118 exits the plurality of transfer passages 94 into the combustion zone 114 and is utilized to combust the flow of pilot fuel 92. In some embodiments, the flow of pilot air 118 mixes, at least partially, with the flow of pilot fuel 92 prior to combustion in the combustion zone 114. In some embodiments, this mixing may occur in the plurality of transfer passages 94. Premixing of the flow of pilot air 118 and the flow of pilot fuel 92 stabilizes the pilot flame 116 and allows for lower operating temperature of the pilot flame 116, thereby reducing NOx emissions in operation of the combustor 14.

FIG. 6 illustrates operation of the secondary nozzle 24 during transfer operation. During transfer mode operation, transfer fuel 96 is urged through the plurality of transfer passages 94 and into the combustion zone 114 from a transfer fuel source 120. In some embodiments, when the transfer fuel 96 is urged through the plurality of transfer passages 94, the flow of pilot air 118 is suspended. In some embodiments, pilot air 118 may be flowed through the transfer passages 94 after the transfer fuel 96, to purge the transfer fuel 96 from the transfer passages 94.

The embodiments described herein utilize the plurality of transfer passages 94 to convey the flow of pilot air 118 during pilot mode operation to combust the flow of pilot fuel 92 and to convey the transfer fuel 96 during transfer mode operation. Utilizing the plurality of transfer passages 94 for both functions allows for elimination of the pilot air passages of the prior art secondary nozzle configuration, resulting in a less complex secondary nozzle 24 with fewer components.

Elimination of the pilot air passages allows for an increase in a total area of the transfer passages 94. This increased area results in a greater fuel flexibility for the secondary nozzle 24, including the use of high reactivity fuels in the pilot. Because of the increased area, a higher volume of transfer fuel 96 can be urged therethrough, so that lower British Thermal Unit (BTU) fuels that require a greater volumetric flow rate may be utilized while maintaining operability of secondary nozzle 24.

Figure 7:
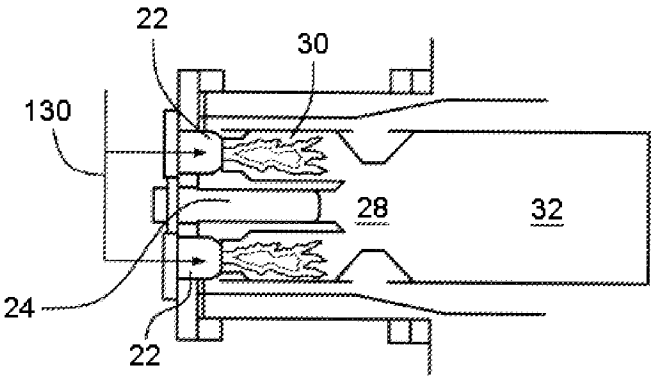

Operation of the combustor 14 will now be described with reference to FIGS. 7 through 10. As shown in FIG. 7, during primary operation, which may be from ignition up to, for example, 20% of the load of the gas turbine engine, all of the fuel supplied to the combustor is primary fuel 130, i.e. 100% of the fuel is supplied to the array of primary nozzles 22. Combustion occurs in the primary combustion chamber 30 through diffusion of the primary fuel 130 from the primary fuel nozzles 22 into the air flow 40 (see FIG. 3) through the combustor 14.

Figure 8:
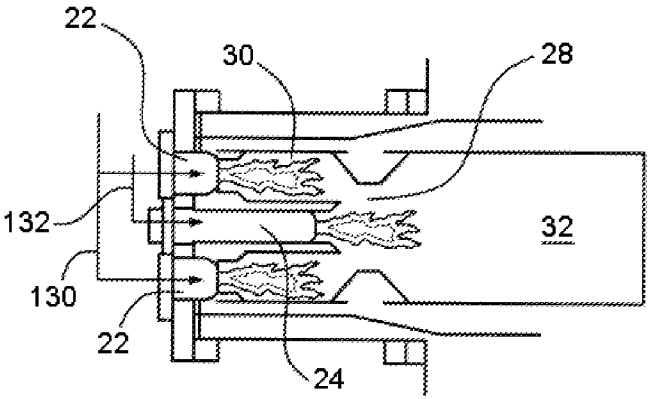
FIGS. 7 through 10 are schematic views depicting the operation of a combustor according to various embodiments of the present disclosure.

As shown in FIG. 8, a lean-lean operation of the combustor 14 occurs when the gas turbine engine is operated at, for example, 20-50% of the load of the gas turbine engine. Primary fuel 130 is provided to the array of primary nozzles 22 and secondary fuel 132 is provided to the secondary nozzle 24. For example, about 70% of the fuel supplied to the combustor is primary fuel 130 and about 30% of the fuel is secondary fuel 132. Combustion occurs in the primary combustion chamber 30 and the secondary combustion chamber 32.

As used herein, the term primary fuel refers to fuel supplied to the primary nozzles 22 and the term secondary fuel refers to fuel supplied to the secondary nozzle 24.

Figure 9:
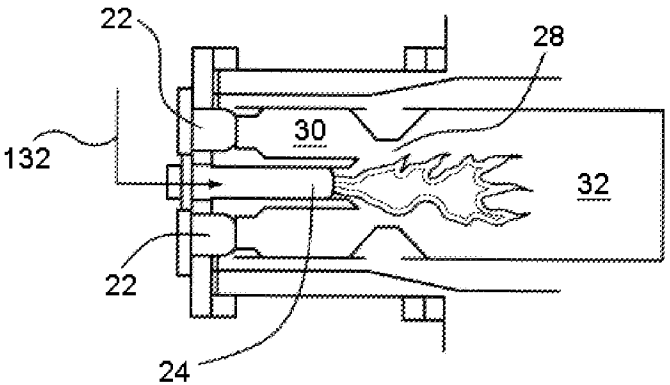

In a second-stage burning, shown in FIG. 9, which is a transition from the operation of FIG. 8 to a pre-mixed operation described in more detail below with reference to FIG. 10, all of the fuel supplied to the combustor is secondary fuel 132, i.e. 100% of the fuel is supplied to the secondary nozzle 24. In the second-stage burning, combustion occurs through premixing of the secondary fuel 132 and the air flow 40 from the inlet 58 of the secondary nozzle 24. The pre-mixing occurs in the fuel-air mixing passage 72 of the secondary nozzle 24.

Figure 10:
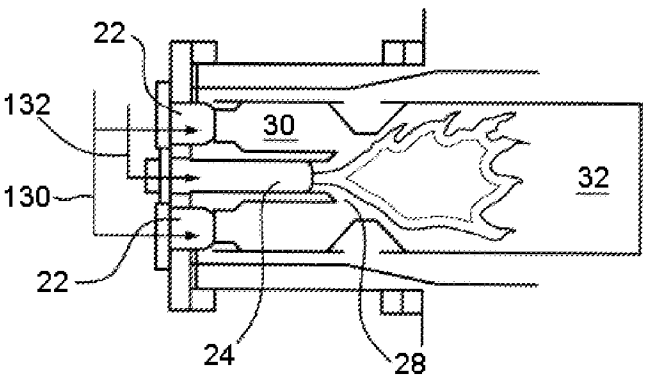

As shown in FIG. 10, the combustor may be operated in a pre-mixed operation at which the gas turbine engine is operated at, for example, 50-100% of the load of the gas turbine engine. In the pre-mixed operation of FIG. 10, the primary fuel 130 to the primary nozzles 22 is increased from the amount provided in the lean-lean operation of FIG. 9 and the secondary fuel 132 to the secondary nozzle 24 is decreased from the amount from provided in the lean-lean operation shown in FIG. 8. For example, in the pre-mixed operation of FIG. 10, about 80-83% of the fuel supplied to the combustor may be primary fuel 130 and about 20-17% of the fuel supplied to the combustor may be secondary fuel 132.

As shown in FIG. 10, during the pre-mixed operation, combustion occurs in the secondary combustion chamber 32 and damage to the secondary nozzle 24 is prevented due to the cooling measures, as discussed above. Referring to FIG. 3, flashback may occur in the event that the flame speed 44 is greater than the velocity of the air flow 40 in the primary combustion chambers 30. Control of the air-fuel mixture in the secondary nozzle 24, i.e. control of the secondary fuel 132, provides control of the flame speed and prevents the flame from crossing the venturi 28 into the primary combustion chamber 30.

Although the various embodiments described above include diffusion nozzles as the primary nozzles, it should be appreciated that the primary nozzles may be premixed nozzles, for example having the same or similar configuration as the secondary nozzles.

The flame tolerant nozzle enhances the fuel flexibility of the combustion system, allowing burning of high reactivity fuels. The flame tolerant nozzle as the secondary nozzle in the combustor makes the combustor capable of burning full syngas as well as natural gas. The flame tolerant nozzle may be used as a secondary nozzle in the combustor and thus make the combustor capable of burning full syngas or high hydrogen, as well as natural gas. The flame tolerant nozzle, combined with a primary dual fuel nozzle, will make the combustor capable of burning both natural gas and full syngas fuels. It expands the combustor's fuel flexibility envelope to cover a wide range of Wobbe number and reactivity, and can be applied to oil and gas industrial programs.

The cooling features of the flame tolerant nozzle, including for example, the swirling vanes of the pre-mixer, and the air cooled burner tube, enable the nozzle to withstand prolonged flame holding events. During such a flame holding event, the cooling features protect the nozzle from any hardware damage and allows time for detection and correction measures that blow the flame out of the pre-mixer and reestablish premixed flame under normal mode operation.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A nozzle for a combustor, the nozzle comprising:
- a center body;
- a burner tube provided around the center body and defining a fuel-air mixing passage therebetween;
- an outer peripheral wall provided around the burner tube and defining an air flow passage therebetween;
- a nozzle tip connected to the center body, the nozzle tip comprising:
  - a pilot fuel passage configured to deliver a flow of pilot fuel to a combustion zone; and
  - a plurality of transfer passages radially outboard of the pilot fuel passage, the plurality of transfer passages configured to deliver a flow of air for combustion with the flow of pilot fuel in the combustion zone and further configured to deliver a flow of transfer fuel to the combustion zone; and
- at least one swirl vane disposed in the fuel-air mixing passage, the swirl vane defining a cooling chamber configured to receive fuel from a premix fuel passage, and
- wherein the fuel flows from the premix fuel passage through a reverse flow passage into the cooling chamber.

2. The nozzle of claim 1, the tip defining a plurality of pilot holes connecting the pilot fuel passage to the plurality of transfer passages.

3. The nozzle of claim 1, the tip defining a diffuser configured such that the flow of pilot fuel flows from the pilot fuel passage through the diffuser into the combustion zone.

4. The nozzle of claim 1, wherein the flow of pilot fuel and the flow of air are at least partially mixed prior to combustion.

5. The nozzle of claim 4, wherein the flow of pilot fuel and flow of air are at least partially mixed in the plurality of transfer passages.

6. The nozzle of claim 1, wherein the burner tube is film-cooled by air in the air flow passage.

7. The nozzle of claim 1, wherein the at least one swirl vane further defines an outlet chamber configured to expel the fuel through at least one fuel injection port into the fuel-air mixing passage, and wherein the at least one swirl vane further comprises a divider provided between the cooling chamber and the outlet chamber.

8. The nozzle of claim 7, wherein the divider defines a by-pass hole configured to permit fuel flow from the cooling chamber to the outlet chamber.

9. A combustor for a gas turbine system, the combustor comprising:
- a nozzle, the nozzle comprising:
  - a center body;
  - a burner tube provided around the center body and defining a fuel-air mixing passage therebetween;
  - an outer peripheral wall provided around the burner tube and defining an air flow passage therebetween;
  - a nozzle tip connected to the center body, the nozzle tip comprising:
    - a pilot fuel passage configured to deliver a flow of pilot fuel to a combustion zone; and
    - a plurality of transfer passages radially outboard of the pilot fuel passage, the plurality of transfer passages configured to deliver a flow of air for combustion with the flow of pilot fuel in the combustion zone and further configured to deliver a flow of transfer fuel to the combustion zone; and
  - at least one swirl vane disposed in the fuel-air mixing passage, the swirl vane defining a cooling chamber configured to receive fuel from a premix fuel passage, and
  - wherein the fuel flows from the premix fuel passage through a reverse flow passage into the cooling chamber.

10. The combustor of claim 9, the tip defining a plurality of pilot holes connecting the pilot fuel passage to the plurality of transfer passages.

11. The combustor of claim 9, the tip defining a diffuser configured such that the flow of pilot fuel flows from the pilot fuel passage through the diffuser into the combustion zone.

12. The combustor of claim 9, wherein the flow of pilot fuel and the flow of air are at least partially mixed prior to combustion.

13. The combustor of claim 12, wherein the flow of pilot fuel and flow of air are at least partially mixed in the plurality of transfer passages.

14. The combustor of claim 9, wherein the at least one swirl vane further defines an outlet chamber configured to expel the fuel through at least one fuel injection port into the fuel-air mixing passage, and wherein the at least one swirl vane further comprises a divider provided between the cooling chamber and the outlet chamber.

15. The combustor of claim 14, wherein the divider defines a by-pass hole configured to permit fuel flow from the cooling chamber to the outlet chamber.

* * * * *